US007678988B2

(12) United States Patent
Sato et al.

(10) Patent No.: US 7,678,988 B2
(45) Date of Patent: Mar. 16, 2010

(54) MUSICAL TONE APPARATUS

(75) Inventors: Takuya Sato, Hamamatsu (JP); Katsuhiko Torii, Hamamatsu (JP); Koji Yoshida, Hamamatsu (JP)

(73) Assignee: Kawai Musical Instruments Mfg. Co., Ltd., Hamamatsu-shi (JP)

( * ) Notice: Subject to any disclaimer, the term of this patent is extended or adjusted under 35 U.S.C. 154(b) by 146 days.

(21) Appl. No.: 11/987,503

(22) Filed: Nov. 30, 2007

(65) Prior Publication Data

US 2008/0127798 A1 Jun. 5, 2008

(30) Foreign Application Priority Data

Dec. 5, 2006 (JP) ..... 2006-328005
Dec. 28, 2006 (JP) ..... 2006-353535
Dec. 28, 2006 (JP) ..... 2006-353536

(51) Int. Cl.
*G10H 1/32* (2006.01)
*G10H 3/00* (2006.01)

(52) U.S. Cl. ..... 84/743; 84/192; 84/718; 84/719; 84/744

(58) Field of Classification Search ..... None
See application file for complete search history.

(56) References Cited

U.S. PATENT DOCUMENTS 4,084,473 A * 4/1978 Kitashima et al. ..... 84/731
7,514,625 B2 * 4/2009 Suzuki ..... 84/723
2007/0028755 A1 * 2/2007 Suzuki ..... 84/746
2007/0084334 A1 * 4/2007 Sato ..... 84/626
2009/0038469 A1 * 2/2009 Suzuki ..... 84/744

FOREIGN PATENT DOCUMENTS

| | | |
|---|---|---|
| JP | A-53-069624 | 6/1978 |
| JP | U-60-150894 | 10/1985 |
| JP | A-04-056996 | 2/1992 |
| JP | A-04-156799 | 5/1992 |
| JP | A-05-073039 | 3/1993 |
| JP | A-05-080748 | 4/1993 |
| JP | A-08-111896 | 4/1996 |
| JP | A-08-146949 | 6/1996 |

* cited by examiner

*Primary Examiner*—Marlon T Fletcher
(74) *Attorney, Agent, or Firm*—Oliff & Berridge, PLC

(57) ABSTRACT

Sounds in different frequency range are generated from the rear, top and/or front face of the musical tone apparatus, sounds are generated and spread in all directions around the musical tone apparatus, and the tones sound very realistically acoustic. Vibration of the sound board does not resonate, tones generated from the sound board are not changed unintentionally, and tones of real acoustic musical instruments are realized. Vibration from the sound board is not directly transferred to the whole musical tone apparatus, by means of not allowing the sound board to touch the body of the musical tone apparatus and of pressing and fixing the soundboard to the attachment component with the thickness of the attachment component compressed.

20 Claims, 8 Drawing Sheets

MUSICAL TONE APPARATUS

BACKGROUND OF THE INVENTION

1. Field of the Invention

The present invention relates to musical tone apparatus and more particularly to musical apparatus of musical instruments the sound board of which vibrates and generates tones.

2. Description of Prior Art

Heretofore the mechanism of such musical instruments that have a vibrating sound board (vibrating-board, diaphragm) is that an electromagnetic driver (transducer) is joined to the sound board of a piano for instance, tones signals are sent to the electromagnetic driver, the sound board, not the electromagnetic driver, is vibrated, and tones are generated from the sound board.

However, sounds generated; from such a sound board (diaphragm) are somewhat different from tones of real acoustic musical instruments.

3. Related Works (1) Publication of utility model application No. 60-150894

(2) Publication of patent application No. 8-146949

(3) Publication of patent application No. 8-111896

(4) Publication of patent application No. 4-156799

(5) Publication of patent application No. 53-69624

(6) Publication of patent application No. 4-56996

(7) Publication of patent application No. 5-80748

(8) Publication of patent application No. 5-73039

(9) Unpublished patent application No. 2006-181135

(10) Unpublished patent application No. 2006-160054

(11) Unpublished patent application No. 2006-151287

(12) Unpublished patent application No. 2006-141954

(13) Unpublished patent application No. 2006-135899

SUMMARY OF THE INVENTION

The present invention implements a back sound generator which generates sounds backward of the keyboard, upper sound generators which generate sounds upward of the keyboard in the different frequency range from that of the said back sound generator, and fore sound generators which generate sounds forward of the keyboard in the different frequency range from those of the said back and upper sound generators.

With the sound generators placed in these positions, sounds in the different frequency ranges are generated from the back, top and front of the musical tone apparatus. As a result sounds are generated and spread all around, and realistic acoustic sounds are realized. Moreover sounds generated in the different directions are in the different frequency ranges. Tone quality/timbre/pitch depend on the direction and distance from the musical tone apparatus. Therefore sounds spread all around and are realistically acoustic.

The present invention includes an attachment component installed to the body of the musical tone apparatus for attaching the edges of the sound board, a flexible intervenient sandwiched between the attachment component and the said edges of the sound board, and a fixing structure pressing the sound board to the attachment component with the said sound board completely off the body of the musical tone apparatus with no space between the said intervenient, the attachment component and the sound board pressing the said intervenient by 0% to 90% in thickness.

By this structure vibration from the sound board is not directly transferred to the whole musical tone apparatus, resonance does not occur among the intervenient, the attachment component and the soundboard, tones generated from the sound board do not change unintentionally and as a result the tones approach very close to tones of real acoustic musical instruments.

In the present invention the electromagnetic driver is mounted off the center of the sound board. Many long and thin sound sticks (ribs) are attached on the surface of the sound board. The spaces between the sound sticks are not uniform and the said electromagnetic driver is placed between the sound sticks.

In this structure as the electromagnetic driver is mounted off the center of the sound board, vibration of the sound board does not resonate, tones generated from the sound board do not change unintentionally and the tones approach very close to tones of real acoustic musical instruments.

Moreover as many long and thin sound sticks are attached on the surface of the sound board and the spaces between the sound sticks are not uniform, tones generated from each space between the sound sticks on the sound board is different from each other in pitch, vibration of the sound board does not resonate, tones generated from the sound board do not change unintentionally and the tones approach very close to tones of real acoustic musical instruments.

In addition as the electromagnetic driver is mounted between the musical sticks, the first vibration of the sound board made by the electromagnetic driver is transferred uniformly to the whole sound board through the sound sticks, and the sounds are not transferred to the sound sticks earlier than to the sound board.

In this specification resonance means abnormal resonance which changes tones generated from the musical tone apparatus, unlike sympathetic vibration. Sympathetic vibration generated at the sound board 11, the front board 6, the base board 2, the attachment frame 3, the inner lower right board 4, the inner lower left board 5, the inner top board 7 are positively or passively allowed.

DESCRIPTION OF THE PREFERRED EMBODIMENT

(1) Summary of the Preferred Embodiment

Figure 1:
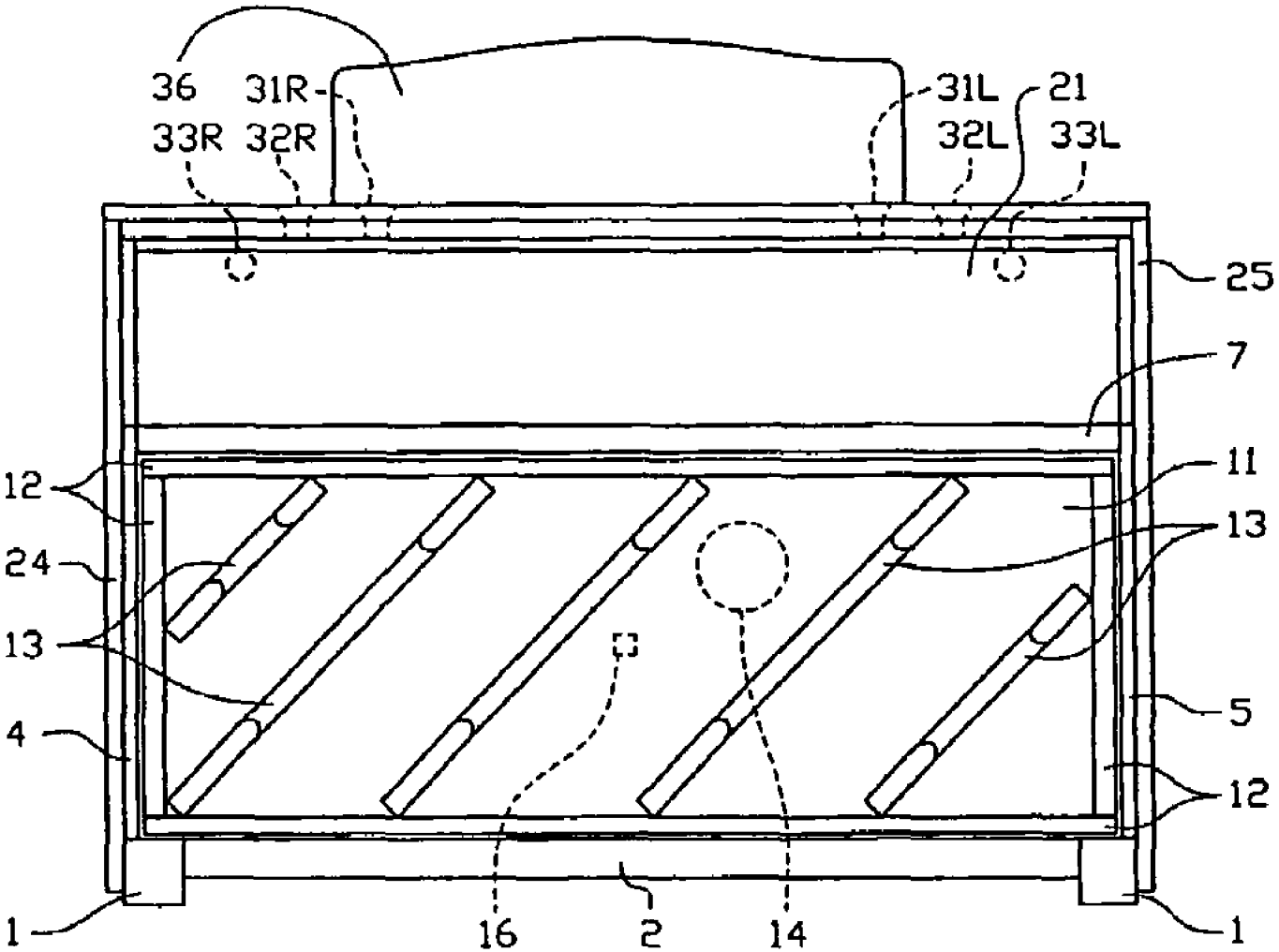
FIG. 1 is a rear view of the musical tone apparatus.

Tones in the low range are generated from the electromagnetic driver unit 14 (transducer) and the sound board 11

(vibrating-board, diaphragm). Tones in the middle range are generated from the upper speakers 31L, 31R, 32L and 32R mounted backward of the keyboard. Tones in the high range are generated from the fore tweeters 33L and 33R generating sounds forward of the keyboard.

The electromagnetic driver unit 14 is mounted off the center of the sound board 11, and so vibration of the sound board 11 does not resonate. Each space between the long and thin sound sticks 13 attached on the surface of the sound board 11 is not uniform. It makes difference in pitch of tones generated from each space between the sound sticks 13 on the sound board 11, and vibration of the sound board 11 does not resonate. The electromagnetic driver unit 14 is placed between the sound sticks 13. The electromagnetic driver unit 14 makes the first vibration on the sound board 11, and then the vibration is transferred to the whole sound board 11 through the sound sticks 13. Sounds are uniformly transferred throughout the sound board 11 as they are not transferred to the sound sticks 13 earlier than the sound board 11.

There is a flexible, elastic and cushiony plug belt 8 between the back side of the vertical rectangular attachment frame 3 on the musical tone apparatus and the sound board 11. The sound board 11 is pressed to the attachment frame 3. By this structure vibration from the soundboard 11 is not directly transferred to the whole musical tone apparatus. Resonance does not occur among the plug belt 8, the attachment frame 3 and the sound board 11. Tones generated from the sound board 11 are not changed unintentionally and the tones approach very close to tones of real acoustic musical instruments.

(2) Musical Tone Apparatus

Figure 2:
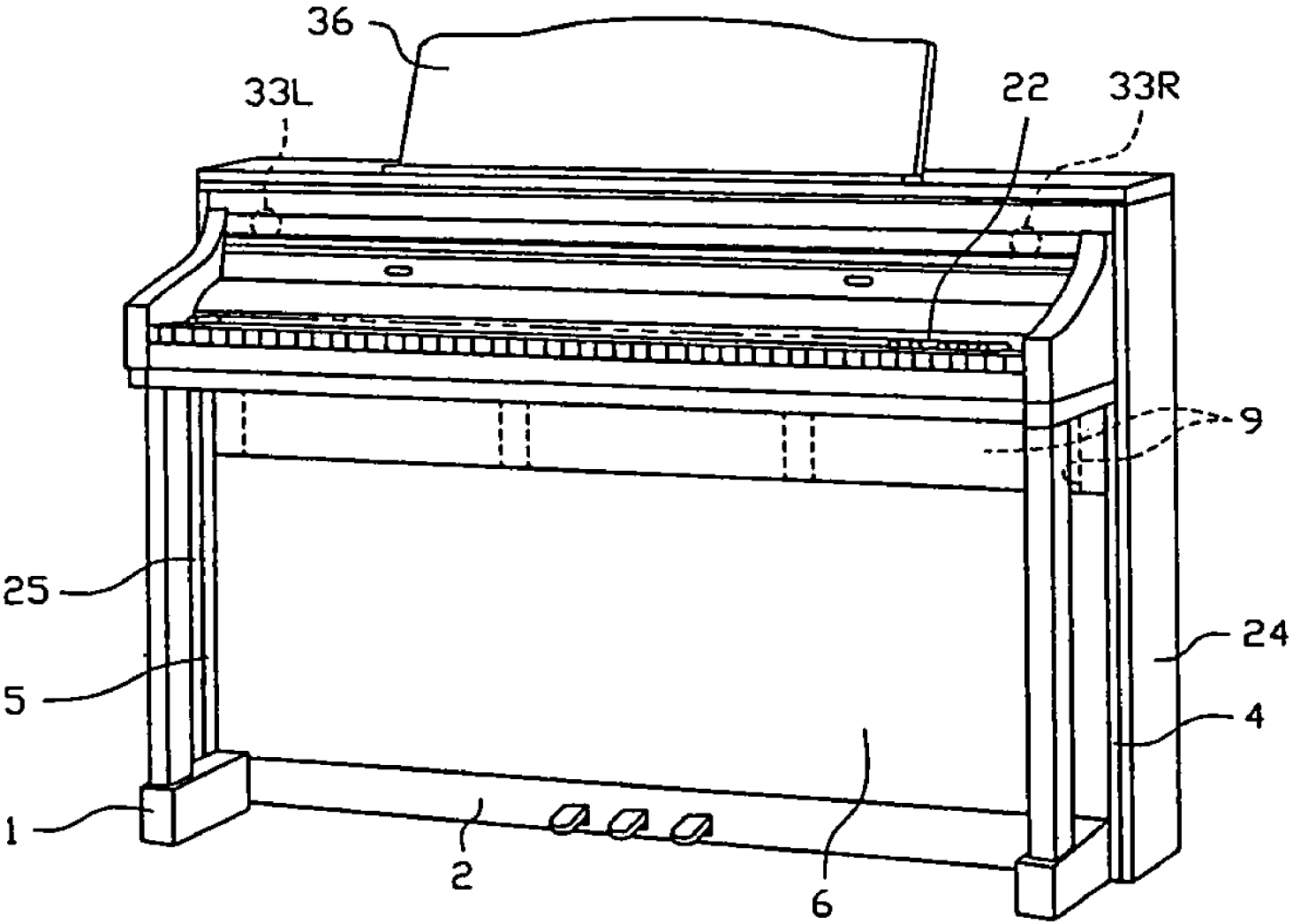
FIG. 2 is a front view of the musical tone apparatus.
Figure 3:
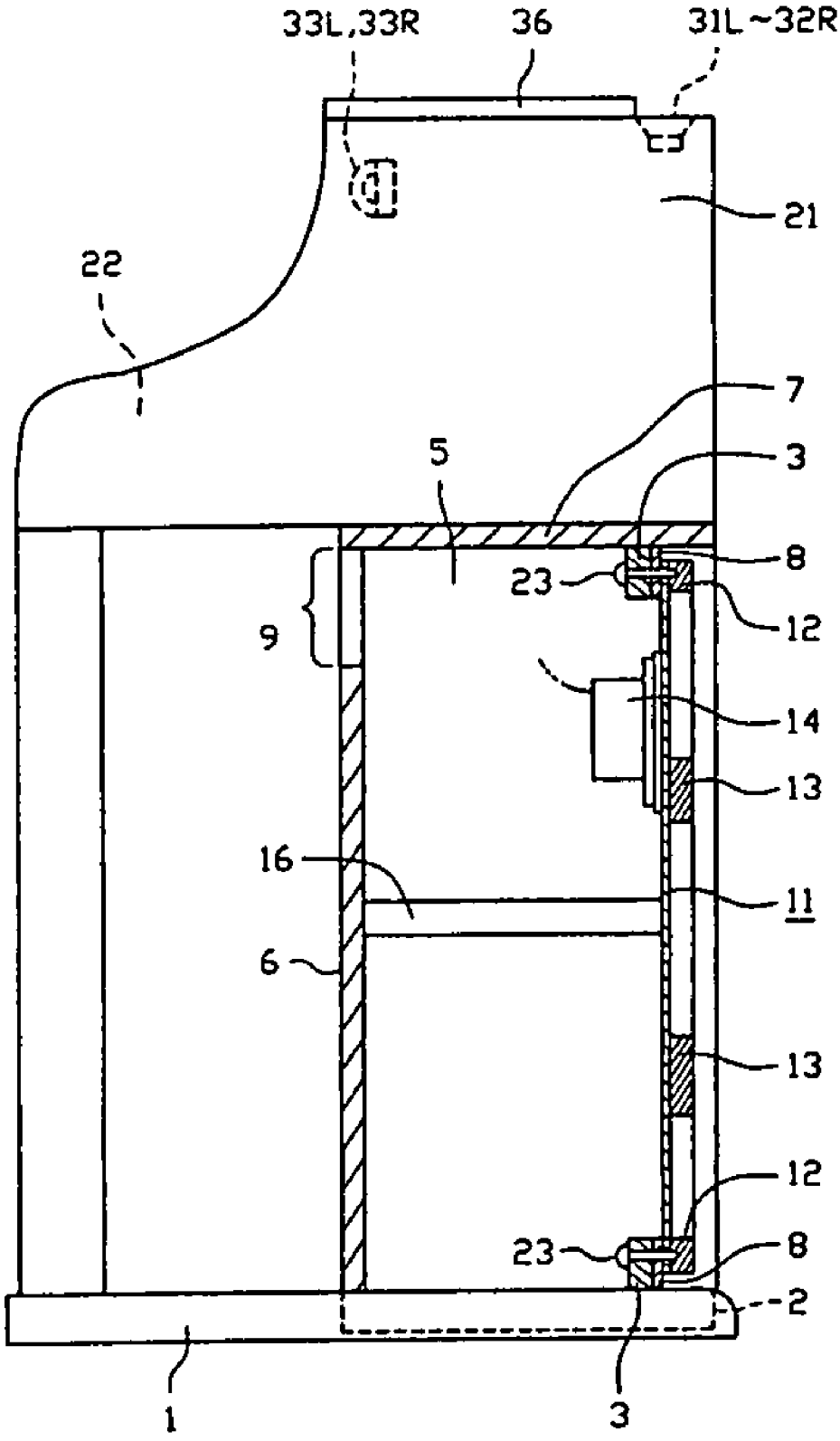
FIG. 3 is a vertical cross sectional view of the musical tone apparatus.
Figure 4:
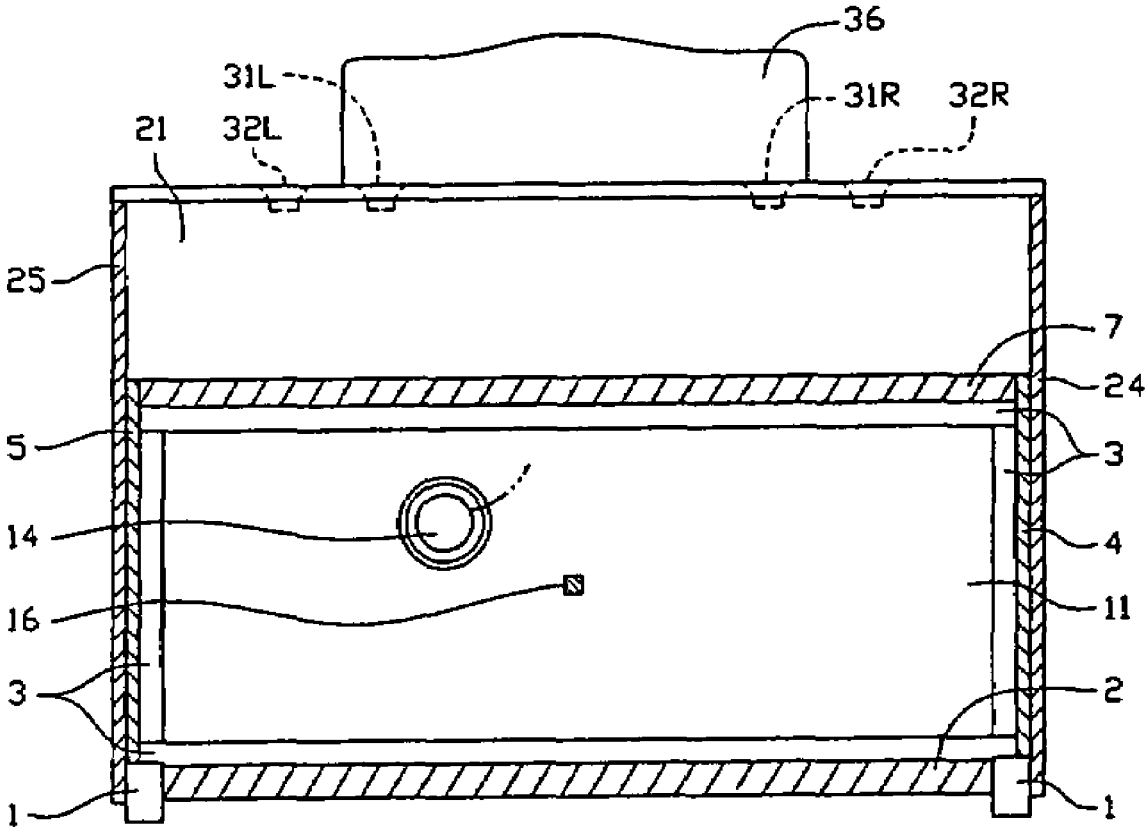
FIG. 4 is a vertical cross sectional view of the musical tone apparatus.
Figure 5:
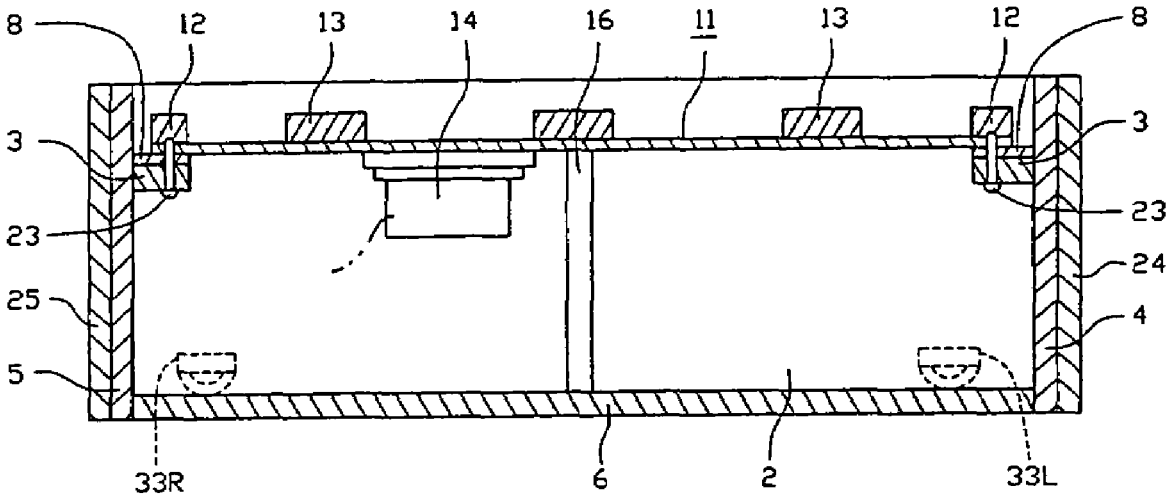
FIG. 5 is a horizontal cross sectional view of the musical tone apparatus.

FIG. 1 shows a rear view, FIG. 2 shows a front view and FIGS. 3, 4, 5 show vertical and horizontal cross sectional views of the musical tones apparatus. A pair of long and thin legs 1, 1 generally made of wood is placed horizontally parallel to each other. The base board 2 generally made of wood connects the legs 1, 1 like a bridge firmly with wooden screws, bolts or an adhesive.

The base board 2 is a long and narrow rectangular and is horizontally placed. The rectangular attachment frame 3 generally made of wood is fixed vertically to the rear edge of the base board 2 with wooden screws, bolts or an adhesive. The inner lower right board 4 and the inner lower left board 5 generally made of wood are fixed vertically to the left and rights sides of the base board 2 and of the rectangular attachment frame 3 with wooden screws, bolts and an adhesive.

The front board 6 generally made of wood is vertically fixed to the front edges of the base board 2, the inner lower right board 4 and the inner lower left board 5 with wooden screws, bolts or an adhesive. These vertical inner lower right board 4, inner lower right board 5, front board 6 and the said attachment frame 3 are all in the same height, and the inner upper board 7 generally made of wood covers these boards like a roof, fixed with wooden screws, bolts or an adhesive.

The back side of the said attachment frame 3 is attached to the surrounding margin of the front side of the sound board 11 generally made of wood with flexible, elastic and/or cushiony plug belt 8 in between. As the soundboard 11 is smaller or slightly smaller than the said attachment frame 3, the sound board 11 never touches the body of the musical tone apparatus including the said base board 2, the attachment frame 3, the inner lower right board 4, the inner lower left board 5, the front board 6 and the inner top board 7. Therefore sound/vibration of the sound board 11 is not transferred directly to the body of the musical tone apparatus, and tones generated from the sound board 11 are not changed unintentionally nor reduces the sound volume.

The said sound board 11 is pressed and fixed to the attachment frame 3 with wooden screws 23, etc. The thickness of the said plug belt 8 is compressed by from 0% to 90%. Then there is no space between the said plug belt 8, the attachment frame 3 and the sound board 11. As a result the said intervenient, the attachment component and the sound board do not hit each other if they are vibrated, abnormal vibration/noise do not occur, tones generated from the sound board 11 are not changed unintentionally and the sound volume is not reduced.

A space between said sound board and said musical tone apparatus is completely sealed. The said plug belt 8, sandwiched in between, completely covers the margin around the said sound board 11 and the attachment frame 3. Inside the musical tone apparatus, the space behind the sound board 11 is completely sealed, that is, the back side, the upper side, the base side, the right side and the left side of the body of the musical tone apparatus are completely sealed. It means that the space surrounded by the said base board 2, the attachment frame 3, the inner lower right board 4, the inner lower left board 5, the front board 6 and the inner top board 7 and the sound board 11 is completely sealed.

Therefore there is no space between the front margins of the surrounding top, bottom, right and left of the sound board 11 and the body of the musical tone apparatus or the said attachment frame 3. They are completely sealed. Owing to the structure, sounds do not leak out and tones generated from the sound board 11 are not changed unintentionally and the sound volume is not reduced.

If sounds leaked out from the sound board 11, the sounds would be generated in the inside of the sound board 11. The phase of the leaking sounds and the phase of the sound wave in the outside of the sound board 11 are inverted, and sounds leaking out from the soundboard would erase sounds from the outside of the sound board 11. Sealing prevents the erasion, tones generated from the sound board 11 are not changed unintentionally and the sound volume is not reduced.

The said front board 6 is cut low so as to provide a space between the front board 6 and the said inner top board 7. The space is the opening 9 which lets air through horizontally. There are four vertical poles standing at the both ends and intermediate points of the opening 9. The poles divide the opening 9 into three. The opening 9 is covered with a mesh cloth. The opening 9 is located at the opposite side of the sound board 11 inside the musical tone apparatus.

Owing to this structure, sounds from the sound board 11 go out through the opening 9. The sounds through the opening 9 are generated from the inside of the sound board 11, and its phase is inverted against the phase from the outside of the sound board 11. But sounds through the opening 9 are generated in the opposite direction, not in the same direction of the outside of the sound board 11, so that sounds from the opening 9 and from the sound board 11 do not erase each other, nor take negative effect to each other, and tones generated from the sound board 11 are not changed unintentionally and the sound volume is not reduced.

The mechanic box 21 is mounted on the said inner top board 7. In front of the mechanical box 21, the keyboard 22 and a group of panel switches are installed. The left and right sides of the mechanic box 21, the outside of the said inner lower right board 4 and of the inner lower left board 5 are attached with the outer right board 24 and the outer left board 25. Inside the mechanic box 21 a tone control circuit, a filter, an amplifier and a speaker are equipped and tone signals are produced in accordance with handling of the keyboard 22 and the panel switches.

Therefore the said musical tone apparatus is a keyboard instrument. The said sound board 11 is mounted at the back side of the musical tone apparatus of the keyboard instrument. The said opening 9 is under the keyboard 22 at the front side of the musical tone apparatus. By this structure, sounds (and also vibration: "sound" always includes "vibration" in this specification) through the opening 9 are transferred to the keyboard 22. As a result performance sounds exactly like real acoustic instruments such as a grand piano or an upright piano.

(3) Soundboard 11

Back Generator

FIG. 3 and FIG. 5 illustrate vertical views of the musical tone apparatus. The shape of the sound board 11 (a back generator), generally made of wood, of musical instruments which generate sounds by vibration is rectangular. The edge around the sound board 11 is smaller or slightly smaller than the edge around the said attachment frame 3. To the back side of the four margins around the sound board 11, the frame sticks 12 generally made of wood are fixed with wooden screws, bolts or an adhesive. By this structure sounds from the sound board 11 are transferred smoothly to the four corners of the sound board 11 and spread out uniformly and tones from the sound board 11 are not changed unintentionally and the sound volume is not reduced.

The sound sticks 13 generally made of wood are attached to the back of the sound board 11 with bolts or an adhesive. The number of the sound sticks 13 to be attached is 2 to 8, preferably 3 to 7, more preferably 4 to 6, or even more preferably 5. Thanks to this structure sounds from the sound board 11 spread out uniformly, not partially, and tones generated from the sound board are not changed unintentionally and the sound volume is not reduced.

The said sound sticks 13 incline 20 to 70 degrees, preferably 30 to 60 degrees, or more preferably 40 to 50 degrees against the level. By this structure sounds from the sound board 11 are not only radiated horizontally and/or vertically but also spread uniformly all over, and tones generated from the sound board 11 are not changed unintentionally and the sound volume is not reduced. As the shape of the sound board 11 is rectangular, sounds from the sound board 11 originally tend to be radiated horizontally and/or vertically.

The said sound board 11 has grains, and the grains are all slanting in the same angle. Each of the said sound sticks 13 crosses at about the right angle to the grains. Sounds from the sound board 11 tend to be transferred along the grains. But as each of the sound sticks 13 have sounds transferred across the grains, sound from the sound board 11 spread uniformly all over, not partially, and tones generated from the sound board 11 are not changed unintentionally and the sound volume is not reduced.

The both ends of the sound sticks 13 reach the said frame 12. Accordingly sounds generated from even the very end of the sound board 11 are radiated not only horizontally and/or vertically but also widely, and tones generated from the sound board 11 are not changed unintentionally and the sound volume is not reduced. The both ends of the sound sticks 13 are thinner, which prevents the sound sticks 13 from resonating with itself. As a result tones generated from the sound board 11 are not changed unintentionally and the sound volume is not reduced.

The space between the said sound sticks is respectively 10 to 30 cm. Width of each space is not equal, but unequal. Accordingly the sound sticks 13 work as node of vibration. Sounds with the same frequency do not resonate between the sound sticks 13, and tones generated from the sound board 11 are not changed unintentionally and the sound volume is not reduced. Such sound sticks 13 may not necessarily be placed at the back side of the sound board 11, but may be placed at the front side or at the both sides.

The space between the said sound sticks 13 is wider as it goes more left of the musical tone apparatus, that is, more right in FIG. 1. The triangle at the lower right corner of the sound board 11 in FIG. 1 is larger than that at the upper left corner of the sound board 11 in FIG. 1. Accordingly sounds in lower pitch are generated more from more right of the sound board 11.

The said keyboard 22 directs generating various sounds in various pitches from high to low ranges. The more left of the keyboard 22 shown in FIG. 2, that is, the more right in FIG. 1 generates lower tones in lower pitches. Accordingly the sound board 11 generates lower sounds more from its part closer to the low tone keys of the keyboard 22, and it realizes feeling very similar to feeling of playing acoustic instruments such as a piano.

In acoustic musical instruments such as a piano, vibration of sounds being generated is transferred to the keyboard 22 just being operated. When lower range keys of the keyboard 22 are operated, vibration of the lower pitch sounds is transferred to the lower range keys. When higher range keys of the keyboard 22 are operated, vibration of higher pitch sounds is transferred to the higher range keys. When middle range keys of the keyboard 22 are operated, vibration of middle pitch sounds is transferred to the middle range keys. The same thing occurs in stringed, wind and percussion instruments. Thus the musical tone apparatus gives a feeling just like playing such real acoustic musical instruments.

As previously stated, the width between the sound sticks 13 is unequal to one another. Pitches of tones generated from the sound board 11 between each sound sticks 13 are different. Therefore vibration of the sound board 11 does not resonate, tones generated from the sound board 11 are not changed unintentionally, sound volume is not reduced, and so the tones approach very close to tones of real acoustic musical instruments.

The ratio of length and width of the sound board 11 is "1:2.51". However it should be "1:0.25 to 5", preferably "1:0.5 to 4", more preferably "1:1 to 3", or even more preferably "1:2 to 2.5". The space between the sound sticks 13 is 1 to 3 times, preferably 1 to 2 times, more preferably 1 to 1.5 times, more preferably 1 to 1.3 times, more preferably 1 to 1.2 times, or even more preferably 1 to 1.1 times as wide as the diameter of the electromagnetic driver unit 14. When the number of the sound sticks 13 is larger, sound volume from the sound board 11 is smaller. When the number of the sound sticks 13 is smaller, the quality of sounds from the sound board 11 is higher.

(4) Electromagnetic Driver Unit 14

(Electromagnetic Driver Rear Generator)

FIG. 1 and FIG. 4 show the location of the electromagnetic driver unit 14 on the soundboard 11. The electromagnetic driver unit (electromagnetic driver/rear generator) is attached between two of the sound sticks 13 . . . on the front (top/face) side of the said sound board 11 with wooden screws and bolts, etc. This attaching structure is described in Japanese Patent Application 2006-181135, 2006-160054, 2006-151287, 2006-141954 and 2006-135899.

The electromagnetic driver unit 14 externally appears to be a columnar case with a round and flat vibrating plate at the base of the case. Inside the electromagnetic driver unit 14, coils and a magnet are contained. Either the said case or the vibrating plate is connected to the coil, and the other of them is connected to the magnet.

When signals of various tones travel through the said coil, magnetic fields around the coil and around the magnet affect each other, causing vibration/drive/displacement of the coil or the magnet and also causing vibration/drive/displacement of the vibration plate to the case. The vibration plate is fixed (or attached/connected/adhered) to the said sound board 11 directly or with connecting components. Therefore with the electromagnetic driver unit 14, signals of various tones are converted to mechanical change, the sound board 11 is driven and sounds are generated.

With this mechanism, the vibrating plate and the sound board 11 are driven electromagnetically and vibrated. The electromagnetic driver unit 14, unlike a speaker, does not generate/radiate sounds itself, but it electromagnetically drives and vibrates something connected to it and has it generate/radiate sound. Such an electromagnetic driver unit as the unit 14 is disclosed in Publications of Japanese Patent Application 8-146949 and 8-111896.

As previously stated, lower tones are mainly generated from the electromagnetic driver unit 14. As shown in FIG. 1, the electromagnetic driver unit 14 is placed slightly upper right off the center of the sound board 11, on the front side of the sound board 11, that is, opposite of the side the sound sticks 13 are attached to. The electromagnetic driver unit 14 on the sound board 11 is placed near the lower range keys of the said keyboard 22.

With this structure lower tones are generated from the right off the center of the sound board 11 in FIG. 1. Accordingly the sound board 11 generates lower sounds more from the parts closer to the low tone keys of the keyboard 22, and it realizes feeling very similar to feeling of playing acoustic instruments such as a piano.

FIG. 1 shows that the electromagnetic driver unit 14 is placed upper from the center of the sound board 11. Therefore lower tones are generated from slightly upper part of the sound board 11 and the tones sound very similar to acoustic musical instruments such as a piano, because real grand pianos and upright pianos generate sounds from the strings installed around the center part, not from a low part of the instruments.

In addition since the electromagnetic driver unit 14 is placed off the center of the sound board 11, vibration of the soundboard 11 does not resonate, tones generated from the sound board 11 are not changed unintentionally, the sound volume is not reduced and the tones approach very close to tones of real acoustic musical instruments.

The electromagnetic driver unit 14 is placed between two of the sound sticks 13. With this structure, after the electromagnetic driver unit 14 vibrates the sound board 11, vibration of the sound board 11 is transferred to the whole sound board 11 through the sound sticks 13, and sounds are transferred uniformly throughout the sound board 11 without being transferred to the sound sticks 13 before to the sound board 11.

The electromagnetic driver unit 14 is placed slightly closer to the upper one of the two sound sticks 13, 13 which sandwich the electromagnetic driver unit 14. In this location vibration of the part of the sound board 11 between the two sound sticks 13, 13 does not resonate, tones generated from the sound board 11 are not changed unintentionally, the sound volume is not reduced, and the tones approach very close to tones of real acoustic musical instruments.

FIG. 1 shows that the electromagnetic unit 14 is placed upper from the center of the sound board 11. It is placed near the opening 9 above the front board of the musical tone apparatus. Thanks to this structure sound/tones through the opening 9 become larger. The electromagnetic driver unit 14 may be placed at the opposite side of the opening 9.

(5) Upper Speakers 31L, 31R, 32L, 32R

Upper Sound Generator

Figure 7:
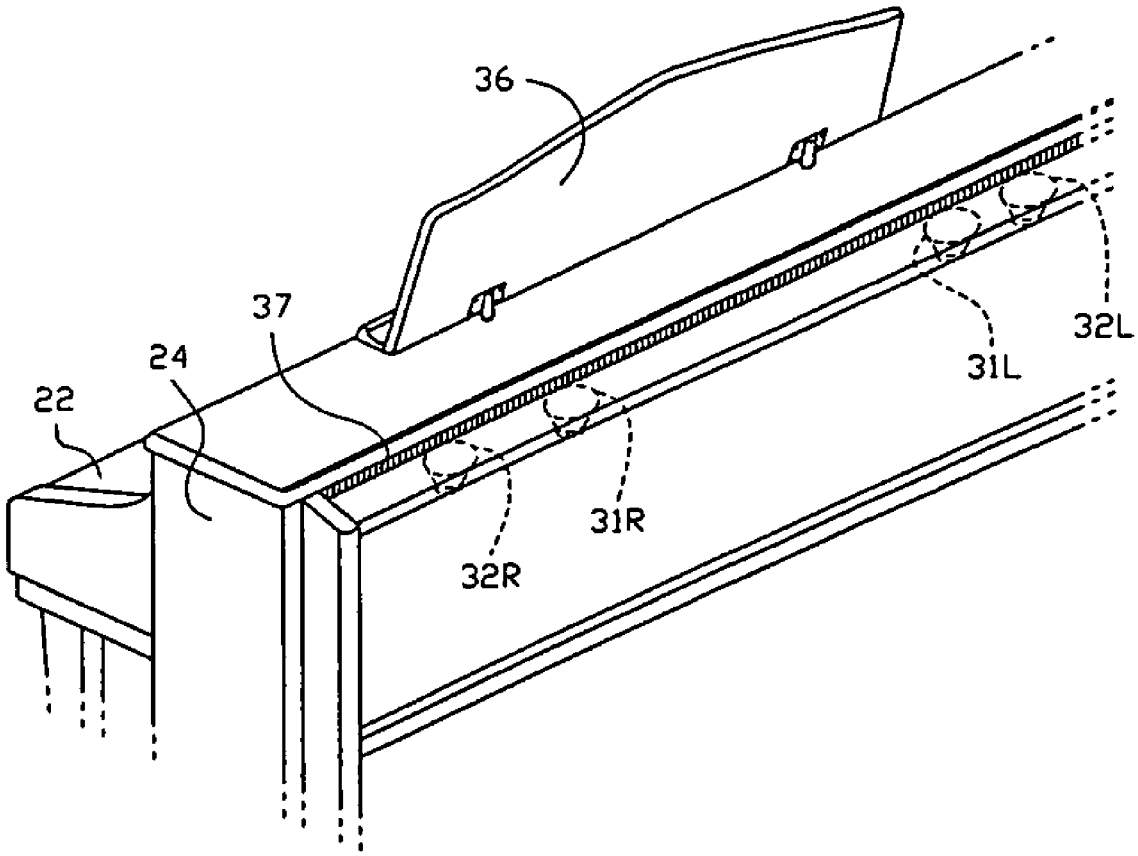
FIG. 7 is an overlook of the musical tone apparatus.

FIG. 7 shows the top of the said musical tone apparatus. The flat music stand 36 is installed near the keyboard 22. It lies or stands on the top of the musical tone apparatus. The music stand 36 is about half as long as the top of the musical instrument. The height of the music stand 36 is about the same as that of the mechanic box 21 or slightly smaller than the width of the top face of the musical tone apparatus. The music stand 36 is slightly inclined backward when it is standing.

There are four holes on the rear face of the mechanic box 21 which is installed on the music tone apparatus. Four upper speakers (upper sound generators) 31L, 31R, 32L, 32R are installed upward in a row. Of the four upper speakers 31L, 31R, 32L, 32R, two speakers 31L and 31R are placed behind and inside of the right and left ends of the music stand 36. The speakers 32L and 32R are placed beside at the back of and outside of the right and left ends of the music stand 36.

Therefore sounds from the two middle upper speakers 31L and 31R are reflected by the standing music stand 36 and radiated backward. Sounds from the two side upper speakers 32L and 32R are radiated mostly upward regardless of the standing music stand 36. As a result sounds are radiated backward and upward and spread, so that very acoustically realistic tones are realized.

Moreover since plural channel signals to form sound images are sent to the two middle upper speakers 31L and 31R respectively, sound images are formed at the two middle speakers 31L and 31R. Similarly since several channel signals to form sound images are sent to the two side upper speakers 32L and 32R, sound images are formed at the two side speakers 32L and 32R. Accordingly sound images are formed both behind and above the musical tone apparatus, so that very acoustically realistic tones are realized.

The four upper speakers 31L, 31R, 32L and 32R receive sound signals in the same frequency range. Therefore sound images in the same frequency range are formed behind and above the musical tone apparatus, so that very acoustically realistic tones are realized. However it is acceptable that the middle speakers 31L and 31R and the side speakers 32L and 32R receive tone signals in different frequency ranges. In this way sound images formed behind and above the musical tone apparatus belong to different frequency ranges, and very acoustically realistic tones are realized.

There may be more upper speakers 31L, 31R, 32L and 32R installed. In this case there may be more middle upper speakers 31L and 32R behind the music stand 36, or more side upper speakers 32L and 32R beside the music stand 36. One or all of the upper speakers 31L, 31R, 32L and 32R may be eliminated.

The upper speakers 31L, 31R, 32L and 32R may be installed in front of the music stand 36, otherwise nearer to the front side or to the back side on the top face of the musical tone apparatus. The upper speakers 31L, 31R, 32L and 32R may be replaced by tweeters. The speakers contain tweeters.

(6) The Fore Tweeters 33L, 33R

Fore Generators

The mechanic box 21 has two holes. The two tweeters 33L and 33R are installed facing ahead with some space in between. Plural channel signals to form sound images are sent to the two fore tweeters 33L and 33R respectively, and the two fore tweeters 33L and 33R form sound images ahead of the musical tone apparatus, so that very acoustically realistic tones are realized.

The fore tweeters 33L and 33R are placed outside of the said side upper speakers 32L and 32R. Accordingly sound images formed by the fore tweeters 33L and 33R are farther from the musical tone apparatus than those formed by the upper speakers 31L, 31R, 32L and 32R, and the sound images spread horizontally rather than vertically to the musical tone apparatus.

The frequency ranges of the tone signals sent to the fore tweeters 33L and 33R are higher than those sent to the said four upper speakers 31L, 31R, 32L and 32R. Therefore sound images formed ahead of and above/behind the musical tone apparatus are different from one another in the frequency range, so that very acoustically realistic tones are realized. In addition frequency range depends on the direction of sound radiation, sound pitch heard depends on how far from the musical tone apparatus the sound is heard. Therefore very widely spread and acoustically realistic sounds are provided.

The fore tweeters 33L and 33R may be placed more inside of the said upper speakers 31L, 31R, 32L or 32R. There may be more fore tweeters 33L and 33R. Or there may not be fore tweeters 33L and 33R. The fore tweeters 33L and 33R may be replaced by speakers.

There is a wide and narrow wall before the said upper speakers 31L, 31R, 32L and 32R. The wall is a part of the mechanic box 21 and the radiator net 37 is attached on it. The radiator net 37 lets out the heat radiated from the tone control circuit (driver circuit), the filter, the amplifier, the upper speakers 31L, 31R, 32L and 32R, the fore tweeters 33L and 33R.

(7) The Connecting Stick 16

The Connector

The connecting stick 16 is a straight stick connecting the center of the inner side of the said sound board 11 and the facing inner side of the front board 6. The connecting stick 16 is secured to the inner side of the sound board 11 and the inner side of the front board 6 with an adhesive, wooden screws and bolts, or is securely nipped by the sound board 11 and the front board 6.

The materials of the connecting stick 16 is the same as or different from those of the said sound stick 13, and is made of metal, resin as well as wood. The shape is a long square pillar. The connecting stick 16 transfers vibration/sound generated from the sound board 11 smoothly to the front board 6, which prevents vibration/sound of the soundboard 11 from being distinguished or disturbed when the front board 6 is vibrated. Accordingly tones generated from the whole sound board 11 are not changed unintentionally and the sound volume is not reduced.

The center of the sound board 11 does not face exactly to the center of the front board 6. So if an end of the connecting stick 16 is attached to the center of the sound board 11 or to the center of the front board 16, the sound board 11 does not resonate with the front board 6, tones generated from the whole sound board 11 are not changed unintentionally and the sound volume is not reduced.

Such a connecting stick as the stick 16 may be attached to the center, the upper/lower/left/right/upper left/lower left/upper right/lower right position off the center, or near the top/bottom/left/right side, or at the top left/bottom left/top right/bottom left corner of the front board 6 as well as at the center of the sound board 11. Thus if the connecting stick 16 is attached off the center of the sound board 11 and the front board 6, the sound board 11 does not resonate with the front board 6, tones generated from the whole sound board 11 are not changed unintentionally and the sound volume is not reduced.

The connecting stick 16 also may be attached to the center/slightly right or left off the center/right or left end under the opening 9. Thus if the connecting stick 16 is positioned near the opening 9, sounds through the opening 9 become louder.

Such a connecting stick as the stick 16 may be fitted at the opposite side of the sound sticks 13 on the sound board 11. In this structure vibration/sound of the sound board 11 is transferred to the front board 6 faster. Also the connecting stick 16 may be attached to connect the back side of the electromagnetic driver unit 14 and the inner side of the front board 6 or may be placed above/under/left/right/upper left/lower left/upper right/lower right of the electromagnetic driver unit 14. With this structure vibration/sound of the electromagnetic driver unit 14 is transferred to the front board 6 faster.

Such a connecting stick as the stick 16 may be attached at the right angle or oblique to the sound board 11, the front board 6 and the electromagnetic driver unit 14. Or there may be more than one connecting stick 16. The connecting stick 16 may be thicker or thinner than the sound sticks 13. The connecting stick 16 may be straight or curved. The cross section of the connecting stick 16 may be of any shape, such as quadrilateral, multilateral, round, oval, semicircular, semicylindrical, fan-shaped if the stick is long enough. Thickness of the connecting stick 16 may be the same or changed through the whole stick. It may have a thicker part after a thinner part alternately, a middle part may be thickest or thinnest, or the ends may be thickest or thinnest.

There is flexible, elastic and/or cushiony plug belt 8 between the sound board 11 connected to the connecting stick 16 and the body of the musical tone apparatus. Therefore if vibration/sound of the sound board 11 is transferred to the body of the musical tone apparatus through the connecting stick 16, the plug belt 8 prevents the vibration/sound from being transferred back to the sound board 11 and the sound board 11 from resonating. Accordingly tones generated from the whole sound board 11 are not changed unintentionally and the sound volume is not reduced.

There may be the plug belt 8 between the both ends of the connecting stick 16 and the sound board 11/the front board 6. The connecting stick 16 may be divided into several parts lengthwise and the plug belt 8 may be sandwiched between the divided parts of the connecting stick 16. By this structure vibration of the sound board 11 cannot be restrained or broken.

Comparing hardness of the sound board 11 and the front board 6 which are connected to each other with the connecting stick 16, the sound board 11 is softer than the front board 6. Accordingly the sound board 11 is more adaptable/responsive to sound/vibration and reverberation is longer toward the front board 6. The sound board 11 may be harder than or as hard as the front board 6.

(8) Plug Belt (Intervenient) 8

The said plug belt (intervenient) 8 is made from flexible, elastic and/or cushiony soft resin such as urethane resin foam, rubber, urethane foam, urethane elastomer, styrene polymer, epoxy, vinyl chloride, vinyl acetate or synthetic rubber, or of cloth, paper or pulp.

For example, the density of the plug belt 8 is 240 kg/m$^3$, 25% compressive load is 0.04 Mpa, the tensile strength is 0.54 Mpa, the elongation percentage is 115%, the tear strength is 1.8N/mm, the compressive residual strain is 2.7% (measured at 70° C.×22 hr, compressed by 50%), the compressive permanent set is 7.6%, the thick tolerance is ±10%. Thickness of the plug belt 8 is, for example, 1.0 to 10.0 mm, preferably 2.0 to 7.0 mm, or more preferably 3.0 to 4.0 mm.

In the compressed condition described below, thickness of the plug belt 8 needs to be at least 0.5 mm or more. Compressed 0% (0.1% to 1.0%) as described below, thickness of the plug belt 8 needs to be at least 0.5 mm or more. Compressed by 90% as described below, thickness of the plug belt 8 needs to be at least 5.0 mm or more.

The said sound board 11 is pressed and attached to the attachment frame 3 with wooden screws, etc. Then thickness of the said plug belt 8 is compressed by 0% (0.1% to 1.0%) to 90%, preferably 0% (0.1% to 1.0%) to 80%, more preferably 0% (0.1% to 1.0%) to 70%, more preferably 0% (0.1% to 1.0%) to 60%, more preferably 0% (0.1% to 1.0%) to 50%, more preferably 0 to 45%, more preferably 0% (0.1% to 1.0%) to 40%, more preferably 0 to 35%, more preferably 0% (0.1% to 1.0%) to 30%, more preferably 0% (0.1% to 1.0%) to 25%, more preferably 0% (0.1% to 1.0%) to 20%, more preferably 0% (0.1% to 1.0%) to 15%, or even more preferably 0% (0.1% to 1.0%) to 10%.

Otherwise thickness of the said plug belt 8 is compressed by 0 (0.1% to 1.0%) to 90%, preferably 0 (0.1% to 1.0%) to 80%, preferably 1 (0.1% to 1.0%) to 70%, more preferably 1 (0.1% to 1.0%) to 60%, more preferably 2 to 50%, more preferably 2 to 45%, more preferably 3 to 40%, more preferably 3 to 45%, more preferably 4 to 30%, more preferably 5 to 15%, or even more preferably 6 to 10%.

If the compression percentage of the thickness of the plug belt 8 is smaller, it is more possible that the said plug belt 8, the attachment frame 3 and the sound board 11 hit each other when they vibrate. However, it rarely occurs that they hit each other at the 0% (0.1% to 1.0%) compression percentage. If the compression percentage of the thickness of the plug belt 8 is larger, vibration is readily transferred from the said sound board 11 to the attachment frame 3, and it becomes more possible that tones generated from the whole sound board 11 are not changed unintentionally and the sound volume is not reduced. When the compression percentage does not exceed 90% and the thickness is 0.5 mm or more, the condition continues that tones generated from the whole sound board 11 are not changed unintentionally and the sound volume is not reduced.

Thus there is no space between the said plug belt 8, the attachment frame 3 and the sound board 11. Accordingly the said plug belt 8, the attachment frame 3 and the sound board 11 do not hit each other when they vibrate, unintentional vibration/noise do not occur, tones generated from the sound board 11 are not changed unintentionally and the sound volume is not reduced.

As there is a flexible, elastic and/or cushiony plug belt 8 between the attachment frame 3 of the said body of the musical tone apparatus and the sound board 11, the sound board 11 does not directly touch the body of the musical tone apparatus, that is, the attachment frame 3.

Therefore sound/vibration of the sound board 11 is not directly transferred to the body of the musical tone apparatus, tones generated from the sound board 11 are not unintentionally changed, and the sound volume is not reduced. If there is no plug belt such as the plug belt 8, vibration of the sound board 11 is restrained/braked to make the sound volume smaller. With such a plug belt as the plug belt 8, vibration of the sound board 11 is not restrained/braked and the sound volume is kept larger.

(9) Opening 9

Figure 6:
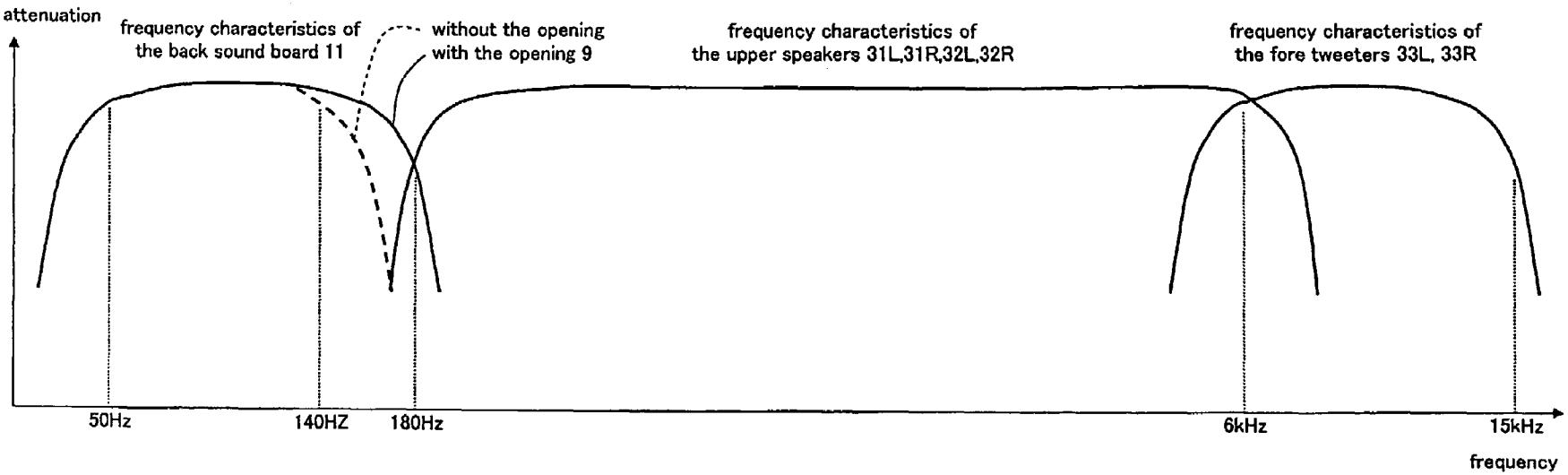
FIG. 6 shows specific frequencies of the sound board 11, the upper speakers 31L, 31R, 32L, 32R and the fore tweeters 33L, 33R.

FIG. 6 shows the frequency characteristics of sounds generated from the sound board 11. In FIG. 6, the solid lines show the characteristics with the opening 9, and the broken line shows the characteristics without the opening 9. When there is an opening 9 on the front face of the body of the musical tone apparatus, sound volume increases in the range from 130 Hz to 150 Hz (around 140 Hz) and to about 180 Hz in the frequency characteristics of the sound board 11.

Sounds through the opening 9 and from the sound board 1 are the same. However, sound through the opening 9 is generated from the inner side of the sound board 11 and its phase is reversed to the phase of the sound generated from the outer side of the soundboard 11. Sound through the opening 9 is radiated in the opposite direction of the outer side of the sound board 11, not in the same direction as the outer side of the sound board 11. Therefore the sounds neither erase nor affect each other, tones generated from the sound board 11 are not changed unintentionally and the sound volume is not reduced.

The preferable position of the opening 9 is near the keyboard 22 on the front board 6 and under or above the keyboard 22. Thanks to this structure a performer feels like being surrounded by the sounds one is playing and playing the acoustic musical instrument.

The opening 9 is divided into three as stated above and there are three openings. Each length of the three openings 9 is about 7 cm. Each width of the three openings 9 is about one third of the width of the front board 6. When the length or the width of the openings 9 are made longer or the number of the openings 9 is made larger, the volume of sound increases in a lower range than 130 Hz to 150 Hz (around 140 Hz) and to about 180 Hz. Thus specific frequency constituent increases or decreases and the frequency characteristics change in various ways.

When the length or the width of the openings 9 are made shorter or the number of the openings 9 is made smaller, the volume of sound increases in a higher range than 130 Hz to 150 Hz (around 140 Hz) and to about 180 Hz. Thus specific frequency constituent increases or decreases and the frequency characteristics change in various ways. Thus the size and the number of the openings 9 are decided so as to make flat or equalize the whole frequency characteristics shown in FIG. 6.

The openings 9 may be positioned in the center, left, right, low, slightly left from the center, slightly right from the center, slightly lower from the center or slightly upper from the center of the front board 6. The openings 9 may be vertically or oblilquely open, and may be of any shape such as round, oval or multilateral. There may be only one opening 9 or more. There may not be a part or the whole of the opening 9.

(10) Driving Circuit

Figure 8:
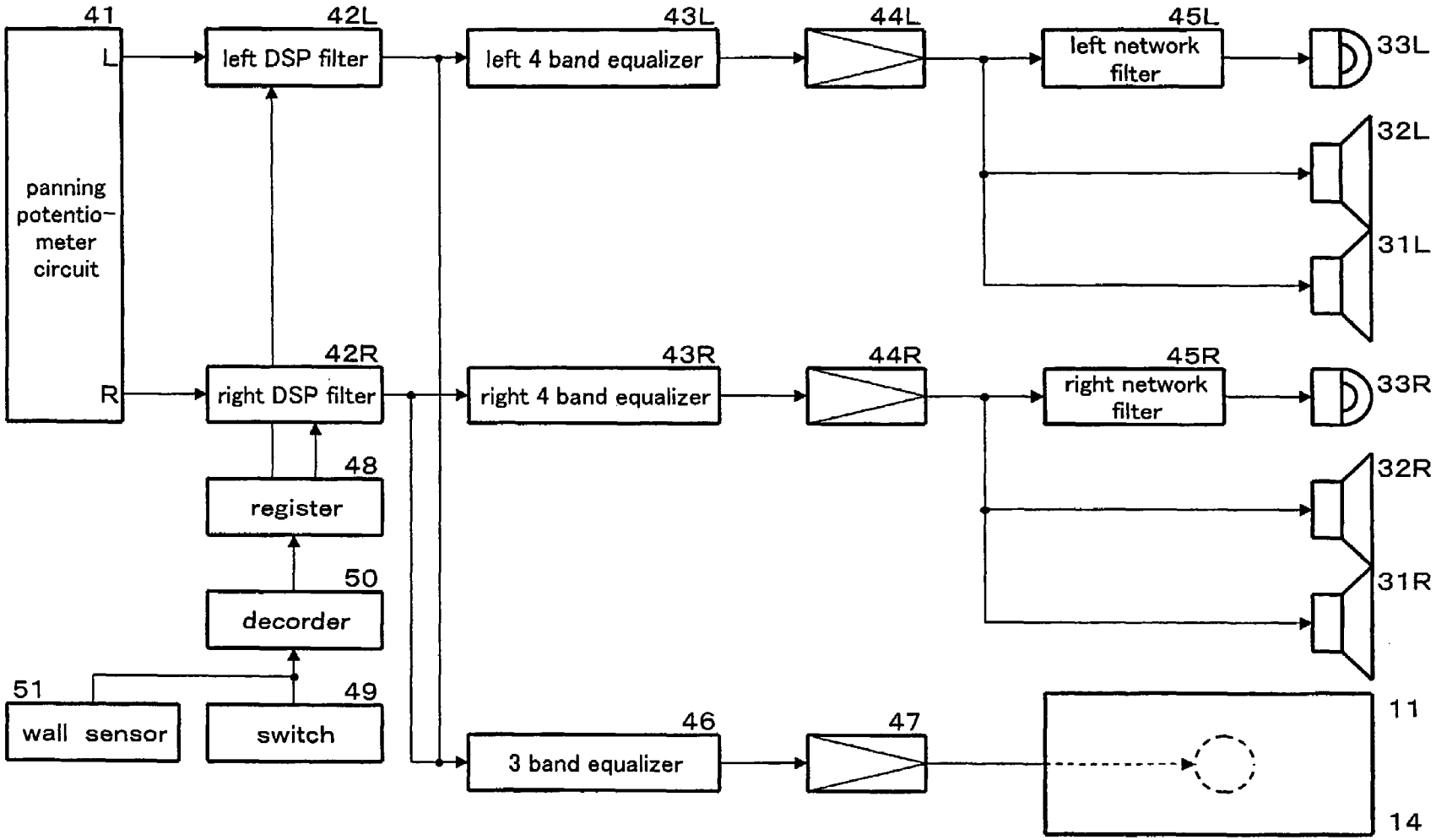
FIG. 8 shows a driving circuit (a tone control circuit) of the electromagnetic driver unit 14, the upper speakers 31L, 31R, 32L, 32R and the fore tweeters 33L, 33R.

FIG. 8 shows the driving circuit (the tone control circuit) of the electromagnetic driver unit 14, the upper speakers 31L, 31R, 32L and 32R, the fore tweeters 33L and 33R. The pan-pot circuit 41 generates a plural number of left and right channel analog tone signals converted from a digital signal to form sound images.

The left tone signal L from the pan-pot circuit 41 is controlled by the left DSP filter 42L. As shown in FIG. 6, the left 4 band equalizer 43L makes the frequency characteristics flat. Then the left tone signal L is amplified by the left amplifier 44L and is generated from the two left upper speakers 31L and 32L. The output of the left amplifier 44L is controlled by the left network filter 45L and is generated from the left fore tweeter 33L. "DSP" means a digital signal processor.

The right tone signal R from the pan-pot circuit 41 is controlled by the right DSP filter 42R. As shown in FIG. 6, the right 4 band equalizer 43R makes the frequency characteristics flat. Then the right tone signal R is amplified by the right amplifier 44R and is generated from the two right upper speakers 31R and 32R. The output of the right amplifier 44R is controlled by the right network filter 45R and is generated from the right fore tweeter 33R.

The left and right tone signals L from the pan-pot circuit 41 are synthesized. As shown in FIG. 6, the 3 band equalizer makes the frequency characteristics flat. Then the signals were amplified by the amplifier 47 and sent to the said electromagnetic driver unit 14 and generated from the said sound board 11.

Through the network filters 45L and 45R, high tones are extracted, and middle and low tones are cut. As shown in FIG. 6, the frequency characteristics of sounds in 6 kHz to 15 kHz are made flat by the equalizer 43R, and the sounds are generated from the fore tweeters 33L and 33R.

Through the left DSP filter 42L and the right DLP filter 42R, the cut-off frequency and/or attenuation are controlled based on the filter setting data sent from the register 48. As shown in FIG. 6, the frequency characteristics of sounds in 180 Hz to 6 kHz are made flat by the left 4 band equalizer 43L and the right 4 band equalizer 43R, and the sounds are generated from the upper speakers 31L, 31R, 32L and 32R.

Through the left DSP filter 42L and the right DSP filter 42R, the cut-off frequency and/or attenuation are controlled based on the filter setting data sent from the register 48. As shown in FIG. 6, the frequency characteristics of sounds in 50 Hz to 180 Hz are made flat by the 3 band equalizer 46, and the sounds are generated from the electromagnetic driver unit 14 and the sound board 11.

In the set of switches on the front control panel of the musical tone apparatus, there is a switch 49 that operates the apparatus when it is placed close to a wall. The on-data of the switch 49 is converted to the filter control data for the cut-off frequency and/or attenuation change by the decoder 50 and is stored in the said register 48.

According to the filter control data, for example, the attenuation/level of middle tone components is lowered in 180 Hz to 6 kHz. As a result when the musical tone apparatus is placed close to a wall, volume of middle tones generated from the upper speakers 31L, 31R, 32L and 32R is reduced.

The left and right DSP filters 42L and 42R may be installed only at the input terminal of the middle upper speakers 31L and 31R. In this structure volume of sounds in the middle range is reduced only at the both sides of the music stand 36, and volume of sounds reflected by the wall is reduced.

The left and right DSP filters 42L and 42R may be installed only at the input terminal of the electromagnetic driver unit 14. In this way volume of sounds in the low range generated only from the sound board 11 is reduced, and volume of sounds reflected by the wall is reduced. Otherwise the left and right DSP filters 42L and 42R may be installed only at the input terminal of the fore tweeters 33L and 33R. In this way volume of sounds in the high range only in front of the music tone apparatus is reduced and volume of sounds reflected by the wall is reduced.

The frequency characteristics shown in FIG. 6 are not those of the tone signals sent to the fore tweeters 33L and 33R, the upper speakers 31L, 31R, 32L and 32R and the electromagnetic driver unit 14, but are the results of measurement of the sounds actually generated from the fore tweeters 33L and 33R, the upper speakers 31L, 31R, 32L, 32R and the sound board 11.

(11) Description of Other Embodiment

The present invention is not limited to the said embodiment but is possible to be modified so long as it does not go beyond the purpose of the present invention. For example, the electromagnetic driver unit 14 (an electromagnetic driver) may be positioned below, right left of, at the upper right, lower right, lower left or upper left corner of the sound board 11.

The electromagnetic driver unit 14 and the sound board 11 may be installed at the top, front, left or right face of the musical tone apparatus. The upper speakers 31L, 31R, 32L and 32R may be installed at the front, rear, left or right face of the musical tone apparatus. The fore tweeters 33L and 33R may be installed at the top, rear, left or right face of the musical tone apparatus.

The number of the fore tweeters 33L and 33R and the upper speakers 31L, 31R, 32L and 32R installed may be one. The tone signals may be sent monaural. The number of the electromagnetic driver unit 14 installed may be plural and the tone signals sent may be plural channel signals to form stereo signals/sound images.

The attachment frame 3, may be eliminated. Instead, the sound board 11 may be attached to the base board 2, the inner lower right board 4, the inner lower left board 5 and the inner top board 7 with the plug belt 8 at the rear position in the musical tone apparatus. Otherwise the sound board 11 may be attached to the outer right board 24 and the outer left board 25 with the plug belt 8 at the rear position in the musical tone apparatus. The attachment component may be included in the musical tone apparatus as one of its parts.

The plug belt 8 may be made from any material so long as it is flexible, elastic or cushiony. The whole or a part of the back side of the attachment frame 3 overlaps the front side of the sound board 11 with the plug belt 8 in between. However they may not overlap at all, and in this case some parts of the plug belt 8 are not covered with both the front side of the sound board 11 and the back side of the attachment frame 3.

The sound board 11 does not at all touch the body of the musical tone apparatus (the base board 2, the attachment frame 3, the inner lower right board 4, the inner lower left board 5, the front board 6 and the inner top board 7), but it may touch a part of them. The plug belt 8 may not necessarily cover the whole margin all around the sound board 11. There may be some space between the margin of the sound board 11 and the body of the musical tone apparatus.

There may be some space between the said sound board 11 and the inner side of the body of the musical tone apparatus facing the sound board 11, and between the said sound board 11 and the inner top face, the inner bottom face, the inner right face and the inner left face of the body of the musical tone apparatus. There may not be the opening 9 of the body of the musical tone apparatus at the opposite side of the sound board 11. There also may not be a part or the whole of either of the inner lower right board 4 or the inner lower left board 5, or of either of the outer right board 24 or the outer left board 25.

A part or the whole of the frame stick 12 of the sound board 11 may be eliminated, or a part or the whole of the sound stick 13 . . . may be eliminated. The cross sections of the sound sticks 13 . . . and the frame sticks 12 of the sound board 11 may be of any shape such as triangle, multilateral, round, oval, semicircular, semicylindrical or fan shape so long as the sticks are long enough. Thickness of the sound sticks 13 . . . and of the frame stick 12 may be changed or unchanged through the whole stick respectively: They may have a thicker part after a thinner part alternately, a middle part may be thickest or thinnest, or the ends may be thickest or thinnest. They may be either straight or bent.

The sound sticks 13 may be attached at regular intervals. They may be attached vertically/lengthways or horizontally/sideways. The sound sticks 13 may be attached at the inner/front side not at the outer/rear side of the sound board 11. It may also be attached at the both sides. In this case they are attached vertically to the straight grain of the sound board 11; however, they may be attached parallel or oblique to the straight grain.

Each interval between the sound sticks 13 may be smaller than the diameter of the electromagnetic driver unit 14. In this case the electromagnetic driver unit 14 is not positioned between the two sound sticks 13, but on one or several of the sound sticks 13. The electromagnetic driver unit 14 may be positioned in the center of the sound board 11. The intervals between the sound sticks 13 may become wider or narrower as it is nearer to the area where the keyboard 22 instructs to generate tones in a low range.

The body of the musical tone apparatus (the base board 2, the attachment frame 3, the inner lower right board 4, the inner lower left board 5, the front board 6 and the inner top board 7 may be of any shape, such as tetrahedron, actrahedron, dodecahedron, cylindrical, columnar, taper, trumpet-shaped, spherical, curved or three-dimensional. The sound board may be of any shape such as quadrilateral, circular, multilateral or ring-shaped so long as it is flat.

The said sound board 11 is flat; however, it may be curved concave or convex. The sound waves generated from the concave or convex sound board 11 are not plane but spherical waves. The electromagnetic driver unit (the electromagnetic driver) 14 may be replaced by speakers or tweeters.

The apparatus of the present invention may be installed to any kind of keyboard instruments such as upright pianos, grand pianos, electric pianos, electric organs, cembalos, electric cembalos, harmonicas having a keyboard or electronic harmonicas having a keyboard. Installed to such musical instruments, the sound board 11 is set almost horizontally/sideways, not vertically/upright, and the electromagnetic driver unit 14 is installed almost horizontally/sideways as well.

The electromagnetic driver unit 14 may not be positioned at the edge of the sound board 11 but near or at the center part. More than one electromagnetic driver unit 14 may be installed on one sound board 11. In this case pairs of the electromagnetic driver units 14 are placed symmetrically at the both edges of the soundboard 11. The electromagnetic driver unit 14 may generate high and middle tones not low tones.

The said tone signals are composed of several signals of various musical instruments, timbres, pitches and/or touches, are signals of polyphonic tones and include tones in low, middle and high frequency ranges. Such tone signals include signals of strings, wind instruments, percussions and also of sound board 11. However the signals may include only those of strings, wind instruments, percussions, or only those of sound board of actual acoustic musical instruments. Tone signals composed of the said various sounds may be digital signals such as PCM.

(12) The Other Effects of the Invention

1. A musical tone apparatus comprising: a keyboard for instructing generation of plural tones indifferent pitches from high to low ranges; a back sound generator which generates sounds backward of the keyboard; upper sound generators which generate sounds upward of the keyboard in the different frequency range from that of the said back sound generator; and fore sound generators which generate sounds forward of the keyboard in the different frequency range from those of the said back and upper sound generators.

2. The musical tone apparatus according to claim 1, wherein: a music stand is installed near said keyboard; plural numbers of said upper sound generators are installed; some of the upper sound generators are positioned behind said music stand; and the other upper sound generators are positioned before or beside said music stand.

Therefore sounds from the upper sound generator are or are not reflected to the upright music stand. The sounds are radiated and spread backward and upward of the musical tone apparatus and very realistic acoustic performance is provided.

3. The musical tone apparatus according to claim 1, wherein: it is detected that a wall exists near the back of the musical tone apparatus, and it is reduced high, middle or low range portion of the frequencies of sounds generated from said upper, fore or back sound generator.

Therefore when this musical tone apparatus is placed very close to a wall, volume of sounds from the upper, fore or back generator is reduced so as to lessen sound reflection to the wall.

4. The musical tone apparatus according to claim 1, wherein: at least one of said back, upper and fore sound generators is a sound board of a musical instrument which vibrates and generates sounds; and an opening is formed facing the sound board installed on the opposite side.

Therefore sound through the opening and from the sound board have a reverse phase to each other and are generated in the other direction to each other. Sounds through the opening and from the sound board do not erase nor affect each other. Then tones generated from the sound board are not changed unintentionally and the sound volume is not reduced.

5. The musical tone apparatus according to claim 1, wherein: at least one of said back, upper and fore sound generators comprises a sound board of a musical instrument which vibrates and generates sounds, and an electromagnetic driver installed to said sound board for converting tone signals composed of plural kinds of tones to mechanical change and driving said sound board of a musical instrument to generate sounds; and as least one of the others comprises speakers.

Therefore the speakers generate sound in some directions around the musical tone apparatus, and the sound board generates acoustic sound in the other directions around the musical tone apparatus.

6. The musical tone apparatus according to claim 1, wherein: at least one of said back, upper and fore sound generators is a sound board of a musical instrument which vibrates and generates sounds; at least one of the others has plural numbers of speakers; and a plural numbers of channel signals to form sound image are sent to each of the speakers.

Therefore the speakers radiate sound with sound image in some directions around the musical tone apparatus, and the sound board generates acoustic sound in the other directions around the musical tone apparatus.

7. The musical tone apparatus according to claim 1, wherein: a long connector is fitted to connect the inner side of the sound board and the inner side of the opposite board, which is a part of the body of the musical tone apparatus and faces to the sound board installed in the musical tone apparatus.

Therefore the connecting component helps vibration/sound of the sound board transferred smoothly to the other inner side. It prevents vibration of the other side from erasing or disturbing vibration/sound of the sound board, and then tones generated from the sound board are not changed unintentionally and the sound volume is not reduced.

8. The musical tone apparatus comprising: a sound board which vibrates and generates sounds; an electromagnetic driver attached out of the center of said sound board for converting tone signals composed of plural kinds of tone to mechanical change and driving said sound board of a musical instrument to generate sounds; and plural numbers of long and thin sound sticks attached to the surface of said sound board with said electromagnetic driver mounted on each space of various width between the sound sticks.

9. The musical tone apparatus according to claim 8, further comprising: a keyboard for instructing generation of plural tones in different pitches form high to low ranges; and said electromagnetic driver attached to said sound board in a position closer to the low range portion of said keyboard.

Therefore sounds are mainly generated from the lower range of the keyboard, and therefore the musical tone apparatus presents sound with emphasis on low tones.

10. The musical tone apparatus according to claim 8, wherein: a keyboard instructs generation of plural tones in different pitches form high to low ranges; and space between said sound sticks becomes wider as it is closer to the lower range portion of said keyboard.

Therefore the nearer on the soundboard to the lower range part of the keyboard, the more low tones are included in the sound, which realizes vibration and feeling very close to performance of real acoustic keyboard instruments.

11. The musical tone apparatus according to claim 8, further comprising: a keyboard for instructing generation of plural tones in different pitches form high to low ranges; and said electromagnetic driver for generating tones mainly in a low range.

Therefore low tones are generated actually from the low range part of the keyboard, which realizes vibration and feeling very close to performance of real acoustic keyboard instruments.

12. The musical tone apparatus according to claim 8, wherein: a long connector is fitted to connect the inner side of the sound board and the inner side of the opposite board, which is a part of the body of the musical tone apparatus and faces to the sound board installed in the musical tone apparatus.

Therefore vibration/sounds are transferred well to the opposite side of the sound board and sounds are well generated from the opposite side of the sound board. Therefore vibration of the sound board does not resonate, tones generated from the sound board are not changed unintentionally and the tones approach very close to tones of real acoustic musical instruments.

13. The musical tone apparatus according to claim 8, further comprising: said electromagnetic driver attached above the center of said sound board.

Therefore vibration of the sound board does not resonate, tones generated from the sound board are not changed unintentionally and the tones approach very close to tones of real acoustic musical instruments.

14. The musical tone apparatus according to claim 8, further wherein: a space between said sound board and said musical tone apparatus is completely sealed.

Therefore sounds from the sound board do not leak leftward, rightward, upward or downward from the sound board, and tones generated from the sound board are not changed unintentionally and the sound volume is not reduced.

15. The musical tone apparatus according to claim 8, further comprising: an opening formed on the opposite side to the side connected to the said sound board installed in the body of the musical tone apparatus.

Therefore vibration of the sound board is transferred to the keyboard, which provides feeling of real acoustic keyboard instruments.

16. The musical tone apparatus comprising: a sound board of a musical instrument which vibrates and generates sounds; an electromagnetic driver for converting tone signals composed of plural kinds of tones to mechanical change and driving said sound board of a musical instrument to generate sounds; an attachment component mounted on the body of the musical tone apparatus for contacting the margin of said sound board; and a flexible intervenient between the attachment component and the margin of said sound board.

17. The musical tone apparatus according to claim 16, further comprising: a fixing structure having said sound board which does not at all touch the body of the musical tone apparatus, without any space between said intervenient, attachment component and sound board, and pressing the sound board to be fixed to the attachment component with said intervenient compressed by 0.1% to 90% in thickness.

Therefore sounds from the sound board are radiated toward the opposite side of the sound board of the musical tone apparatus. The radiated sounds and sounds from the sound board do not erase nor affect each other. Tones generated from the sound board are not changed unintentionally and the sound volume is not reduced. Vibration of the sound board is radiated ahead of the musical tone apparatus, which provides feeling of performance of real acoustic keyboard instruments.

18. The musical tone apparatus according to claim 16, wherein: said intervenient completely covers the whole surrounding margin of said sound board; and the whole surrounding margin of said sound board is tightly adhered to the body of the musical tone apparatus without any space.

Therefore sounds from the sound board do not leak around the sound board, tones generated from the sound board are not changed unintentionally and the sound volume is not reduced.

19. The musical tone apparatus according to claim 16, further wherein: a space between said sound board and said musical tone apparatus is completely sealed.

Therefore sounds from the sound board do not leak leftward, rightward, upward or downward from the sound board, and tones generated from the sound board are not changed unintentionally and the sound volume is not reduced.

20. The musical tone apparatus according to claim 16, further comprising: an opening formed on the opposite side to the side connected to the said sound board installed in the body of the musical tone apparatus.

Therefore sounds from the sound board are radiated toward the opposite side of the sound board of the musical tone apparatus. The radiated sounds and sounds from the sound board do not erase nor affect each other. Tones generated from the sound board are not changed unintentionally and the sound volume is not reduced. Vibration of the sound board is radiated ahead of the musical tone apparatus, which provides feeling of performance of real acoustic keyboard instruments.

21. The musical tone apparatus according to claim 16, further comprising: said intervenient having elasticity and/or cushioning elect as well as flexibility.

Therefore sounds from the sound board are not transferred to the body of the musical tone apparatus, tones generated from the sound board are not changed unintentionally and the sound volume is not reduced.

22. The musical tone apparatus according to claim 16, further comprising: said intervenient compressed in thickness by 0.1 to 50%.

Therefore there is no space between the attachment component, the intervenient and/or the sound board, abnormal vibration/resonance do not occur between them, tones generated from the sound board are not changed unintentionally and the sound volume is not reduced.

23. The musical tone apparatus according to claim 16, wherein: said musical tone apparatus is a keyboard instrument; said sound board is installed near the back inside the musical tone apparatus of a keyboard instrument; and an opening is formed at the front side of the musical tone apparatus below the keyboard.

Therefore vibration of the sound board is transferred to the keyboard, which provides feeling of real acoustic keyboard instruments.

The invention claimed is:

1. A musical tone apparatus comprising:

a keyboard for instructing generation of plural tones in different pitches from high to low ranges;

a back sound generator which generates sounds backward of the keyboard;

upper sound generators which generate sounds upward of the keyboard in the different frequency range from that of the said back sound generator;

fore sound generators which generate sounds forward of the keyboard in the different frequency range from those of the said back and upper sound generators; and a wall which is detected to exist near the back of the musical tone apparatus.

2. The musical tone apparatus according to claim 1, wherein:

it is reduced high, middle or low range portion of the frequencies of sounds generated from said upper, fore or back sound generator.

3. The musical tone apparatus according to claim 1, wherein:

at least one of said back, upper and fore sound generators is a sound board of a musical instrument which vibrates and generates sounds; and an opening is formed facing the sound board installed on the opposite side.

4. The musical tone apparatus according to claim 1, wherein:

at least one of said back, upper and fore sound generators comprises a sound board of a musical instrument which vibrates and generates sounds, and an electromagnetic driver installed to said sound board for converting tone signals composed of plural kinds of tones to mechanical change and driving said sound board of a musical instrument to generate sounds; and at least one of the others comprises speakers.

5. The musical tone apparatus according to claim 1, wherein:

at least one of said back, upper and fore sound generators is a sound board of a musical instrument which vibrates and generates sounds;

at least one of the others has plural numbers of speakers; and a plural number of channel signals to form sound image are sent to each of the speakers.

6. The musical tone apparatus according to claim 1, wherein:

a long connector is fitted to connect the inner side of the sound board and the inner side of the opposite board, which is a part of the body of the musical tone apparatus and faces to the sound board installed in the musical tone apparatus.

7. A musical tone apparatus comprising:

a sound board which vibrates and generates sounds;

an electromagnetic driver attached out of the center of said sound board for converting tone signals composed of plural kinds of tone to mechanical change and driving said sound board of a musical instrument to generate sounds;

plural numbers of long and thin sound sticks attached to the surface of said sound board with said electromagnetic driver mounted on each space of various width between the sound sticks; and a space between said sound board and said musical tone apparatus is completely sealed.

8. The musical tone apparatus according to claim 7, further comprising:

a keyboard for instructing generation of plural tones in different pitches form high to low ranges; and said electromagnetic driver attached to said sound board in a position closer to the low range portion of said keyboard.

9. The musical tone apparatus according to claim 7, wherein:

a keyboard instructs generation of plural tones in different pitches form high to low ranges; and space between said sound sticks becomes wider as it is closer to the lower range portion of said keyboard.

10. The musical tone apparatus according to claim 7, further comprising:

a keyboard for instructing generation of plural tones in different pitches form high to low ranges; and said electromagnetic driver for generating tones mainly in a low range.

11. The musical tone apparatus according to claim 7, wherein:

a long connector is fitted to connect the inner side of the sound board and the inner side of the opposite board, which is a part of the body of the musical tone apparatus and faces to the sound board installed in the musical tone apparatus.

12. The musical tone apparatus according to claim 7, further comprising:

said electromagnetic driver attached above the center of said sound board.

13. The musical tone apparatus according to claim 7, further comprising:

an opening formed on the opposite side to the side connected to the said sound board installed in the body of the musical tone apparatus.

14. A musical tone apparatus comprising:

a sound board of a musical instrument which vibrates and generates sounds;

an electromagnetic driver for converting tone signals composed of plural kinds of tones to mechanical change and driving said sound board of a musical instrument to generate sounds;

an attachment component mounted on the body of the musical tone apparatus for contacting the margin of said sound board;

a flexible intervenient between the attachment component and the margin of said sound board; and a space between said sound board and said musical tone apparatus is completely sealed.

15. The musical tone apparatus according to claim 14, further comprising:

a fixing structure having said sound board which does not at all touch the body of the musical tone apparatus, without any space between said intervenient, attachment component and sound board, and pressing the sound board to be fixed to the attachment component with said intervenient compressed by 0.1% to 90% in thickness.

16. The musical tone apparatus according to claim 14, wherein:

said intervenient completely covers the whole surrounding margin of said sound board; and the whole surrounding margin of said sound board is tightly adhered to the body of the musical tone apparatus without any space.

17. The musical tone apparatus according to claim 14, further comprising:

an opening formed on the opposite side to the side connected to the said sound board installed in the body of the musical tone apparatus.

18. The musical tone apparatus according to claim 14, further comprising:

said intervenient having elasticity and/or cushioning elect as well as flexibility.

19. The musical tone apparatus according to claim 14, further comprising:

said intervenient compressed in thickness by 0.1 to 50%.

20. The musical tone apparatus according to claim 14, wherein:

said musical tone apparatus is a keyboard instrument;

said sound board is installed near the back inside the musical tone apparatus of a keyboard instrument; and an opening is formed at the front side of the musical tone apparatus below the keyboard.

* * * * *